US009958805B2

(12) United States Patent
Matsushita et al.

(10) Patent No.: US 9,958,805 B2
(45) Date of Patent: May 1, 2018

(54) IMAGE FORMING APPARATUS

(71) Applicant: CANON KABUSHIKI KAISHA, Tokyo (JP)

(72) Inventors: Shunsuke Matsushita, Yokohama (JP); Kodai Hayashi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/388,194

(22) Filed: Dec. 22, 2016

(65) Prior Publication Data

US 2017/0184996 A1 Jun. 29, 2017

(30) Foreign Application Priority Data

Dec. 25, 2015 (JP) ..... 2015-252860
Dec. 2, 2016 (JP) ..... 2016-234840

(51) Int. Cl.
*G03G 15/06* (2006.01)

(52) U.S. Cl.
CPC ..... *G03G 15/065* (2013.01)

(58) Field of Classification Search
CPC combination set(s) only.
See application file for complete search history.

(56) References Cited

U.S. PATENT DOCUMENTS

| | | | | |
|---|---|---|---|---|
| 9,116,459 | B2 | 8/2015 | Yamamoto et al. | |
| 9,411,259 | B2 | 8/2016 | Hayashi et al. | |
| 9,411,260 | B2 | 8/2016 | Mitsui et al. | |
| 2011/0164900 | A1* | 7/2011 | Onishi | G03G 15/0121 399/223 |
| 2012/0063797 | A1* | 3/2012 | Hirota | G03G 15/0818 399/55 |

FOREIGN PATENT DOCUMENTS

JP 2013-228584 A 11/2013

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

An image forming apparatus includes a developing device including a developer carrying member, a developer supplying member and a regulating member. Also provided are a first power source for the developer carrying member, a second power source for the regulating member, and a controller. In a period from a start of a developing operation to an end of the developing operation for printing an image on a single recording material, the controller effects control of a potential difference between the developer carrying member and the developing blade so that a force for urging the developer from the regulating member toward the developer carrying member acts on the developer at a contact portion between the regulating member and the developer carrying member. The force acting on the developer being is stronger at the end of the developing operation than at the start of the developing operation.

11 Claims, 9 Drawing Sheets

IMAGE FORMING APPARATUS

FIELD OF THE INVENTION AND RELATED ART

The present invention relates to an image forming apparatus such as an electrophotographic apparatus, e.g., a copying machine, a printer or a facsimile machine, or an electrostatic recording apparatus, in which a developing device is used.

Conventionally, the image forming apparatus such as an electrophotographic copying machine, a laser beam printer or a facsimile machine includes the developing device. In the developing device, a developing roller which is provided so as to close an opening of a developer container accommodating principally a developer and which is partly exposed, and a developer amount regulating blade for regulating an amount of the developer, to a certain amount, fed by the developing roller in contact with a surface of the developing roller are provided.

The developer deposited on the surface of the developing roller is removed in an excessive amount from the surface of the developing roller when the developer passes through between the developing roller and the developer amount regulating blade with rotation of the developing roller, and is returned into the developer container, so that the developer is formed in a thin layer on the developing roller. Simultaneously, triboelectric charges are imparted to the developer by friction of the developer with the developer amount regulating blade. Then, the developer is fed from a portion, where the developing roller is partly exposed from the developing container, to a developing region which is an adjacent region to a photosensitive drum as an image bearing member, so that the developer moves onto an electrostatic latent image formed on the photosensitive drum.

Toner remaining on the developing roller without being used in the developing region (hereinafter, the toner is referred to as a development residual toner) is scraped off by mechanical friction (sliding) between the developing roller and a developer supplying roller. Simultaneously therewith, the developer is supplied from the developer supplying roller to the developing roller. On the other hand, the developer scraped off from the developer supplying roller is mixed with the developer positioned inside and at a periphery of the developer supplying roller.

Conventionally, in such a developing device, depending on a printing pattern during image formation, a phenomenon that a half-tone density on a background (color) portion and a half-tone density immediately after printing of a solid image are different from each other (hereinafter referred to as a developing ghost) generated in some cases. The developing ghost generates due to a triboelectric charge difference depending on a difference in printing pattern.

Here, a problem generating in the developing device was the developing ghost such that the triboelectric charge of the toner on the developing roller at a non-printing portion (hereinafter referred to as after white) is relatively higher than the triboelectric charge of the toner on the developing roller at a printing portion (hereinafter referred to as after black) (hereinafter, this developing ghost is referred to as a development positive ghost). Therefore, in order to stabilize coating of the developer on the developing roller, a technique in which a potential difference is provided between the developing roller and the developer amount regulating blade so that the developer is urged from the developer amount regulating blade toward the developing roller has been known (Japanese Laid-Open Patent Application 2013-228584). However, even when such a potential difference was provided, a difference in triboelectric charge between after white and after black generated, and therefore the development positive ghost generated.

SUMMARY OF THE INVENTION

According to an aspect of the present invention, there is provided an image forming apparatus comprising: a developing device including a rotatable developer carrying member for carrying a developer, a developer supplying member for supplying the developer to the developer carrying member, and a regulating member for regulating an amount of the developer carried by the developer carrying member in contact with the developer carrying member; a first power source for applying a bias to the developer carrying member; a second power source for applying a bias to the regulating member; and control means for controlling the first and second power sources, wherein in a period from a start of a developing operation to an end of the developing operation for a same recording material, the control means effects control of providing a potential difference between the developer carrying member and the developing blade so that a force for urging the developer from the regulating member toward the developer carrying member acts on the developer at a contact portion between the regulating member and the developer carrying member, the force acting on the developer being stronger at a time of the end of the developing operation than at a time of the start of the developing operation.

Further features of the present invention will become apparent from the following description of exemplary embodiments with reference to the attached drawings.

DESCRIPTION OF THE EMBODIMENTS

Embodiments of the present invention will be described specifically with reference to the drawings. However, dimensions, materials, shapes and relative arrangement of constituent elements described in the following embodiments are not intended such that the scope of the present invention is limited only thereto unless otherwise specified.

Embodiment 1

(Image Forming Apparatus)

Figure 1:
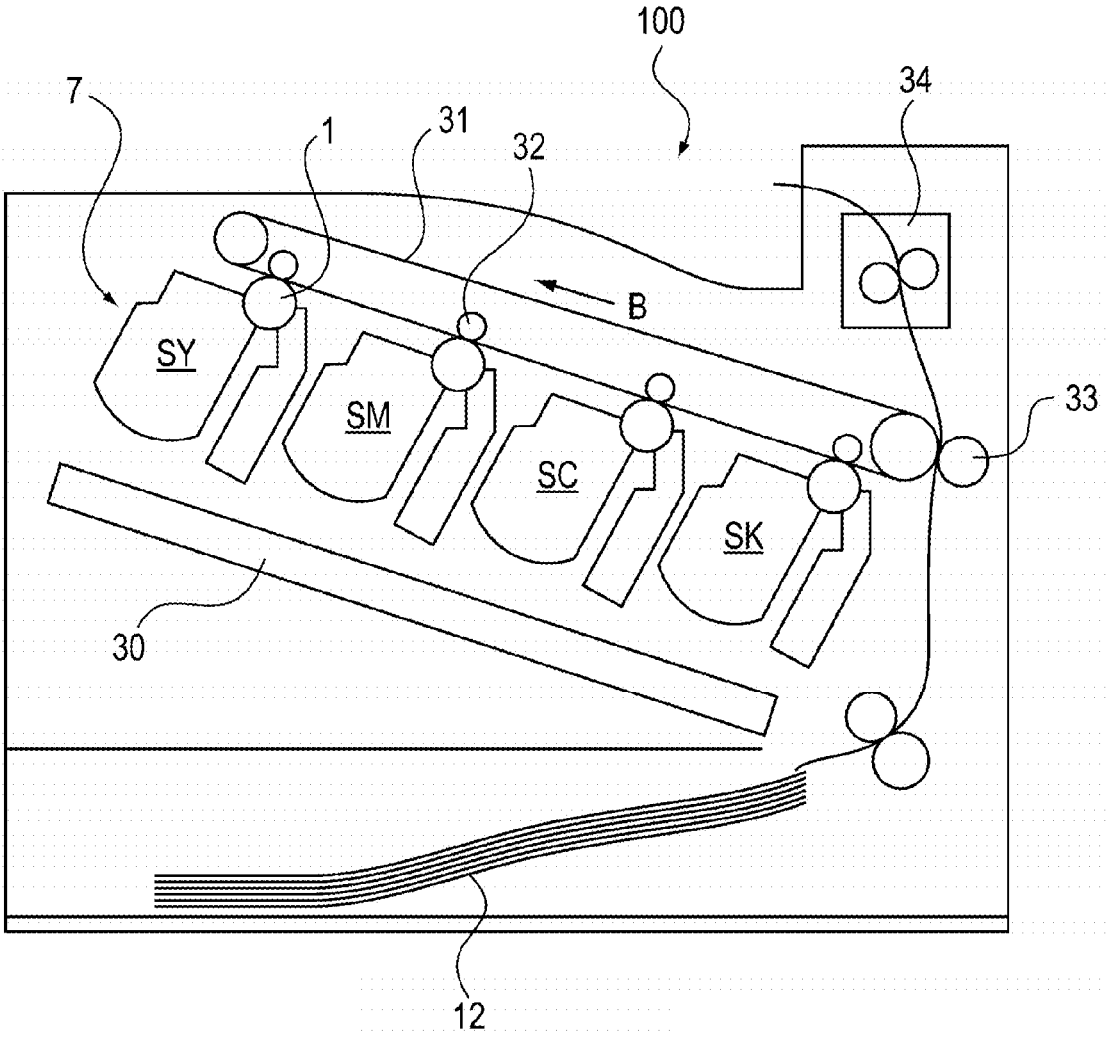
FIG. 1 is a schematic view of an image forming apparatus.

A general structure of an image forming apparatus in this embodiment according to the present invention will be described. FIG. 1 is a schematic sectional view of an image forming apparatus 100. The image forming apparatus 100 in this embodiment is a full-color laser beam printer (electrophotographic image forming apparatus) employing an in-line type and an intermediary transfer type.

The image forming apparatus 100 is capable of forming a full-color image on a recording material (such as a recording sheet, a plastic sheet or a cloth) in accordance with image information is inputted into an image forming apparatus main assembly from an image reading device connected with the image forming apparatus main assembly or a host device such as a personal computer communicatably connected with the image forming apparatus main assembly. The image forming apparatus 100 includes image forming portions SY, SM, SC and SK for forming images of colors of yellow (Y), magenta (M), cyan (C) and black (K), respectively. In this embodiment, the image forming portions SY, SM, SC and SK are disposed in line along a direction crossing a vertical direction.

Each of the image forming portions includes a process cartridge 7 integrally including a photosensitive drum (image bearing member) 1 and process means (charging means, developing means, cleaning means) actable on the photosensitive drum 1. The process cartridge 7 at each of the image forming portions is detachably mountable to the image forming apparatus 100 through mounting means such as a mounting guide, a positioning member and the like.

In this embodiment, all the process cartridges 7 for the respective colors have the same shape and accommodate toners of the respective colors of yellow (Y), magenta (M), cyan (C) and black (K), respectively.

In this embodiment, as described later, a process cartridge including a photosensitive member unit 13 provided with the photosensitive drum 1 and the like and a developing unit 12 provided with a developing roller 4 and the like will be described. However, the present invention is not limited thereto, but may also employ a constitution in which the developing unit (developing device) 3 is detachably mountable singly to the image forming apparatus main assembly.

The photosensitive drum 1 is rotationally driven by a drum driving means M1. At a periphery of the photosensitive drum 1, a scanner unit (exposure device) 30 is provided. The scanner unit 30 is an exposure means for forming an electrostatic (latent) image on the photosensitive drum 1 by irradiating a surface of the photosensitive drum 1 with laser light on the basis of the image information. Writing of the laser exposure is carried out by a positional signal, in a polygon scanner, which is called a BD signal every scanning line with respect to a main scan direction (perpendicular to a feeding direction of the recording material). On the other hand, with respect to a sub-scan direction (the feeding direction of the recording material), the writing is carried out with a delay of a predetermined time by a TOP signal sent from a switch (unshown) in a recording material feeding path. As a result, at the four process stations Y, M, C and K, the laser exposure can be carried out always at the same position on the photosensitive drum 1.

An intermediary transfer belt 31 as an intermediary transfer member for transferring toner images from the four photosensitive drums 1 onto a recording material 12 is provided opposite to the four photosensitive drums 1.

The intermediary transfer belt 31 formed with an endless belt as the intermediary transfer member contacts all the photosensitive drums 1 and circulates and moves (rotates) in an arrow B direction (counterclockwise direction) indicated in FIG. 1.

In an inner peripheral surface side of the intermediary transfer belt 31, as primary transfer means, four primary transfer rollers 32 are juxtaposed so as to oppose the photosensitive drums 10.

Then, to the primary transfer roller 32, a bias of an opposite polarity to a normal charge polarity of the toner is applied from an unshown primary transfer bias voltage source (high voltage source) as a primary transfer bias application means. As a result, that the toner image is transferred (primary-transferred) from the photosensitive drum 1 onto the intermediary transfer belt 31. In an outer peripheral surface side of the intermediary transfer belt 31, as secondary transfer means, a secondary transfer roller 33 is provided.

Then, to the secondary transfer roller 33, a bias of an opposite polarity to the normal charge polarity of the toner is applied from an unshown secondary transfer bias voltage source (high voltage source) as a secondary transfer bias application means. As a result, the toner images are secondary-transferred from the intermediary transfer belt 31 onto the recording material 12. For example, during full-color image formation, the above-described process is successively performed in the image forming portions SY, SM, SC and SK, and then the toner images of the respective colors are primary-transferred superposedly onto the intermediary transfer belt 31. Thereafter, in synchronism with movement of the intermediary transfer belt 31, the recording material 12 is fed to the secondary transfer portion. Then, by the action of the secondary transfer roller 33 contacting the recording material S toward the intermediary transfer belt 31, the four color toner images are secondary-transferred collectively from the intermediary transfer belt 31 onto the recording material 12. The recording material 12 on which the toner images are transferred is fed to a fixing device 34 as a fixing means. In the fixing device 34, heat and pressure are applied to the recording material 12, so that the toner images are fixed on the recording material 12.

(Process Cartridge)

Next, a general structure of the process cartridge to be mounted in the image forming apparatus in this embodiment will be described.

Figure 2:
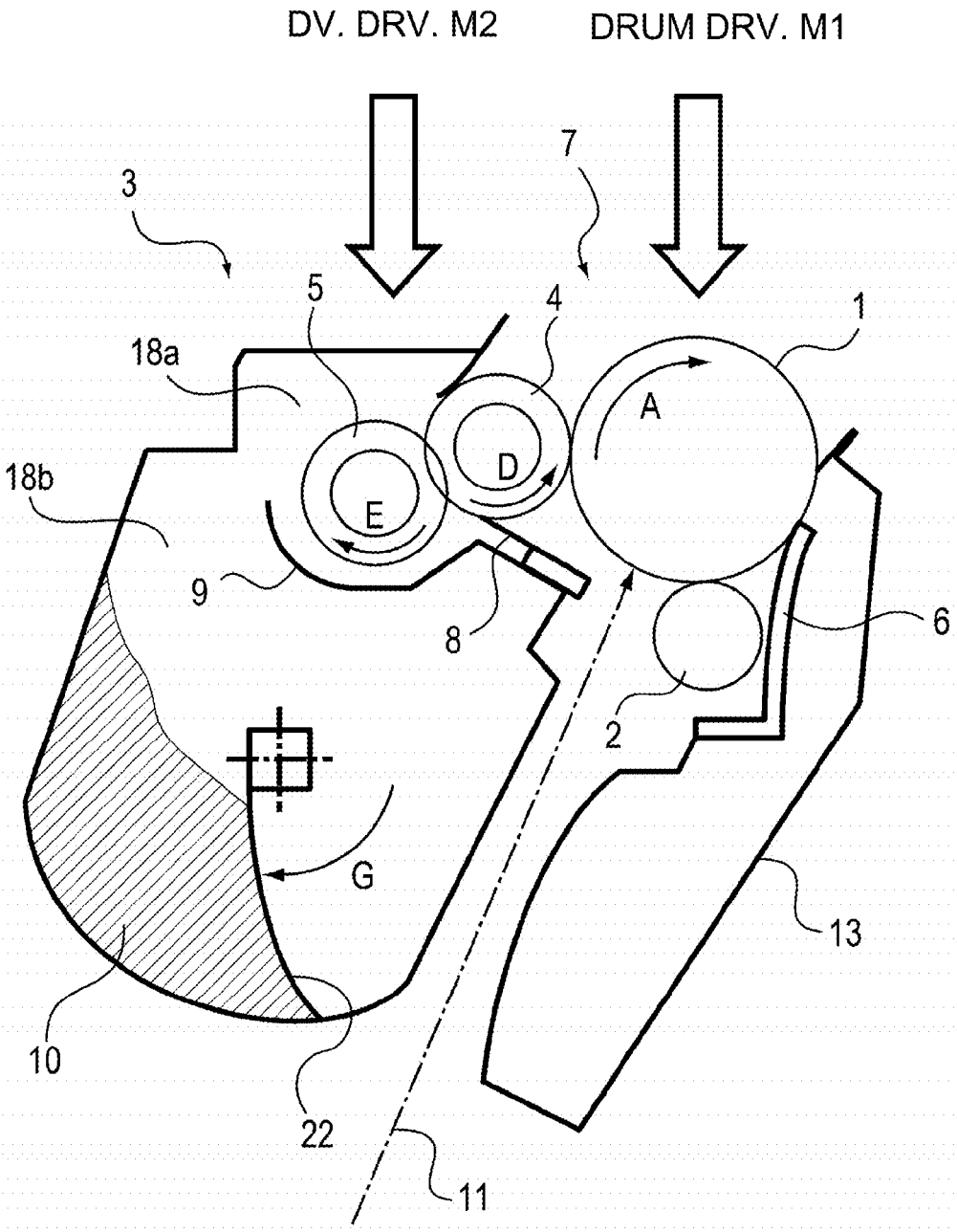
FIG. 2 is a schematic view of a process cartridge in Embodiment 1.

FIG. 2 is a schematic sectional view of the process cartridge 7 in this embodiment as seen in a longitudinal direction (rotational axis direction) of the photosensitive drum 10. In this embodiment, constitutions and the operations of the process cartridges for the respective colors are the substantially the same except for species (colors) of the accommodated developer.

The process cartridge 7 includes a photosensitive member unit 13 including the photosensitive drum 1 and the like, and a developing unit 3 including the developing roller 4 and the like.

To the photosensitive member unit 13, the photosensitive drum 1 is rotatably mounted via an unshown bearing. The photosensitive drum 1 is rotationally driven in the indicated arrow A direction depending on the image forming operation by receiving a driving force of a driving motor as an unshown drawn driving means M1.

In the photosensitive member unit 13, the charging roller 2 and the cleaning member 6 are disposed so as to contact the peripheral surface of the photosensitive drum 1. To the charging roller 2, from a charging bias power source (voltage source) (not shown) as a charging bias applying means, a bias enough to place arbitrary electric charges on the photosensitive drum 1 is applied. In this embodiment, a bias applied to the charging roller 2 so that a potential (charge potential Vd) on the photosensitive drum 1 is −500 was set Then, the photosensitive drum 1 is irradiated with laser light 11 from the scanner unit 30 on the basis of the image information, so that the electrostatic latent image is formed on the photosensitive drum 1. In this embodiment, a light quantity of the laser light 11 was set at 0.2 $\mu J/cm^2$ during the image formation so as to provide a latent image potential of −150 V.

On the other hand, the developing unit (developing device) 3 includes a developing chamber 18*a* and a developer accommodating chamber 18*b* disposed below the developing chamber 18*a*. Inside the developer accommodating chamber 18*b*, toner (developer) 10 is accommodated. In this embodiment, a normal charge polarity of the toner is negative (polarity), and in the following, the case where a negatively chargeable toner is used will be described. However, the toner in this embodiment is not limited thereto.

In the developer accommodating chamber 18*b*, a developer feeding member 22 for feeding the toner 10 to the developing chamber 18*a* is provided and feeds the toner 10 to the developing chamber 18 by being rotated in an arrow G direction.

In the developing chamber 18*a*, the developing roller 4 as a developer carrying member rotated in an arrow D direction in FIG. 2 by receiving a driving force from a driving motor as a developing roller driving M2 in contact with the photosensitive drum 1 is provided. In this embodiment, the developing roller 4 and the photosensitive drum 1 rotate so that their surfaces move in the same direction at a contact portion where they oppose each other. Further, to the developing roller 4, a bias enough to develop and visualize the electrostatic latent image on the photosensitive drum 1 in the toner image is applied from a developing bias power source (not shown) as a developing applying means.

Inside the developing chamber 18*a*, a supplying roller 5 as a developer supplying member for supplying the toner, fed from the developer accommodating chamber 18*b*, to the developing roller 4 is provided. Further, inside the developing chamber 18*a*, a toner amount regulating member (hereinafter referred to as a regulating blade or regulating member) 8 for regulating a coating amount of the toner, on the developing roller 4, supplied by the supplying roller and for imparting electric charges is provided.

Constitutions of the developing roller 4, the supplying roller 5 and the regulating member 8 will be specifically described.

The developing roller 4 is 15 mm in diameter and is prepared by forming a base layer of silicone rubber on an electroconductive core metal of 6 mm in diameter and then by forming a surface layer of urethane rubber on the base layer. As regards a volume resistivity of the developing roller 4, the developing roller 4 having a resistance of $10^4$-$10^{12}\Omega$ can be used.

The supplying roller 5 is 15 mm in diameter and is an electroconductive elastic sponge roller prepared by forming a foam material layer on an outer peripheral surface of an electroconductive core metal of 6 mm in diameter, and as regards a volume resistivity thereof, the supplying roller 5 having a resistance of $10^4$-$10^8\Omega$ can be used. In this embodiment, the supplying roller 5 used was $4\times10^6\Omega$ in resistance value and 200 gf in hardness. The hardness of the supplying roller 5 in this embodiment is a value obtained by measuring a load when a flat plate of 50 mm in longitudinal width is caused to enter the supplying roller 5 by 1 mm.

The regulating member 8 is a SUS metal plate of 0.1 mm in thickness and is disposed in contact with the developing roller 4 so that a free end thereof is positioned upstream of the developing roller 4 with respect to a developing roller rotational direction. In this embodiment, as the regulating member 8, a regulating member prepared by cutting a free end of a SUS metal plate from a developing roller contact surface side was used. A free end of the regulating member 8 contacting the developing roller 4 is bent in a cutting direction by the cutting and a bending amount thereof corresponding to a radius of curvature R is 0.02 mm.

To the developing roller 4, a developing bias is applied using a high-voltage source (not shown) for the developing bias. Further, a supplying roller bias is applied to the supplying roller 5 using a high-voltage source (not shown) for the supplying roller bias, and a regulating blade bias is applied to the regulating member 8 using a high-voltage source (not shown) for the regulating blade bias.

At this time, in the case where a value obtained by subtracting a value of the bias, applied to the developing roller 4, from a value of a bias applied to the supplying roller 5 has the same polarity as the normal charge polarity of the toner, a force in a direction in which the toner is urged from the supplying roller 5 toward the developing roller 4 acts on the toner at a contact portion between the supplying roller 5 and the developing roller 4.

Further, in the case where a value obtained by subtracting a value of the bias, applied to the developing roller 4, from a value of a bias applied to the supplying roller 5 has the opposite polarity to the normal charge polarity of the toner, a force for urging the toner from the supplying roller 5 toward the developing roller 4 acts on the toner.

For example, when the developing bias is −300 V and the supplying roller bias is −400 V, a difference therebetween is −100 V, so that the toner is urged from the supplying roller 5 toward the developing roller 4.

The toner supplied from the supplying roller 5 to the developing roller 4 enters the contact portion between the regulating member 8 and the developing roller 4 by rotation of the developing roller 4 in the arrow D direction. The toner entered into the contact portion between the regulating member 8 and the developing roller 4 is triboelectrically charged by friction between the surface of the developing roller 4 and the regulating member 8, so that electric charges are imparted to the toner and at the same time, a layer thickness of the toner is regulated.

At this time, in the case where a value obtained by subtracting a value of the bias, applied to the developing roller 4, from a value of a bias applied to the regulating member 8 has the same polarity as the normal charge polarity of the toner, a force in a direction in which the toner is urged from the regulating member 8 toward the developing roller 4 acts on the toner at a contact portion between the regulating member 8 and the developing roller 4.

Further, in the case where a value obtained by subtracting a value of the bias, applied to the developing roller 4, from a value of a bias applied to the regulating member 8 has the opposite polarity to the normal charge polarity of the toner, a force in a direction in which the toner is urged from the regulating member 8 toward the developing roller 4 acts on the toner.

As the force in the direction in which the toner is urged from the regulating member 8 toward the developing roller 4 strongly acts on the toner, a frictional force at the contact portion between the regulating member 8 and the developing roller 4 becomes strong, so that the triboelectric charge is promoted and thus an amount of charges imparted to the toner becomes large.

The toner, on the developing roller 4, which is regulated in layer thickness is fed to an opposing portion to the photosensitive drum 1 by the rotation of the developing roller 4, so that the electrostatic latent image is developed and visualized as the toner image with the toner.

A development residual toner on the developing roller 4 enters the contact portion with the supplying roller 5 by the rotation of the developing roller 4. A part of the development residual toner is collected by the supplying roller 5 by mechanical friction between the developing roller 4 and the supplying roller 5 and by a potential difference between the developing roller 4 and the supplying roller 5, and is mixed with the toner in the supplying roller 5 and the toner at a periphery of the supplying roller 5. On the other hand, the toner remaining on the developing roller 4 without being collected by the supplying roller 5 is mixed with a toner newly supplied from the supplying roller 5 while being supplied with the electric charges by the friction with the supplying roller 5.

Control of each of the power sources for applying the biases to the developing roller 4, the supplying roller 5 and the regulating member 8 is carried out by a control means. Using FIG. 8, a control system of the image forming apparatus in this embodiment will be described briefly. A controller 150 as the control means provided in the image forming apparatus 100 is constituted by including a CPU 151 which is a central element for performing computation (processing), a memory 152 such as a ROM or a RAM, which is a storing element, and the like. In the RAM, a detection result of a sensor, a computation (calculation) result and the like are stored, and in the ROM, a control program, a data table obtained in advance, and the like are stored. The controller 150 is the control means for effecting integrated control of an operation of the image forming apparatus 100 and controls transfer of various electrical information signals and timing of drive and the like, and manages a predetermined image forming sequence and the like. To the controller 150, respective portions to be controlled are connected. For example, to the controller 150, a first power source E1 for applying the bias to the developing roller 4, a second power source E2 for applying the bias to the regulating member 8, a third power source E3 for applying the bias to the supplying roller 5, the scanner unit (exposure means) 30, and the like are connected. For example, the controller 150 controls the potential difference between the developing roller 4 and the supplying roller 5 and the potential difference between the developing roller 4 and the regulating member 8 by controlling the respective power sources. This control by the controller 150 will be described later using a timing chart shown in FIG. 3.

(Generating Mechanism of Developing Ghost)

A generating mechanism of the developing ghost will be described.

The developing ghost generates due to a difference between a charge amount of the toner on the developing roller 4 after black and a charge amount of the toner on the developing roller 4 after white. The difference in toner charge amount between toners after white and after black is attributable to a difference in number of times of friction (sliding) of the respective toners. The toner on the developing roller 4 after white has the charge amount in which the charge amount by the friction at the contact portion between the developing roller 4 and the regulating member 8 is added to the charge amount of the development residual toner triboelectrically charged in advance. On the other hand, the toner on the developing roller 4 after black has the charge amount obtained by only once of the friction at the contact portion between the developing roller 4 and the regulating member 8. Due to the difference in number of times of friction, the toner charge amount after white is liable to be higher than the toner charge amount after black.

An image pattern used for discriminating a developing ghost level in this embodiment includes, in addition to a solid patch image, a pattern obtained by printing a half-tone image on an entire surface where a density of the solid patch image measured by a densitometer ("SPECTRODENSITOMETER 500" manufactured by X-Rite Inc.) after one full circumference (turn) of the developing roller is 0.6. In this embodiment, at a position corresponding to a half-tone portion of the image pattern, where the solid patch image is printed, after one full circumference (turn) of the developing roller, i.e., at a position corresponding to after white, the toner charge amount on the developing roller is relatively low. Accordingly, based on a development y characteristic, at the half-tone portion, the amount of the toner, used for development, moved from the developing roller becomes relatively large compared with that after white, so that the development positive ghost generates.

Further, as regards the development positive ghost, there was a problem that a degree thereof becomes worse at a trailing end of the image than the first half of the image. This is because the toner charge amount on the developing roller after white is determined by the number of times of friction, and therefore when after white is continued to the second half of the image, the toner charge amount becomes very high. On the other hand, as regards after black, friction is performed only once, and therefore the toner charge amount is constant even in the first half and in the second half. Accordingly, a difference in charge amount between after white and after black becomes larger with a position of the image from a leading end toward a trailing end, so that the degree of the development positive ghost becomes worse.

In order to improve such a development positive ghost, the toner charge amount after white and the toner charge amount after black are made close to each other when the toner charge amount on the developing roller after black can be made large while suppressing the toner charge amount on the developing roller after white, so that the development positive ghost can be improved. Further, when the charge amount given to the toner on the developing roller 4 after black can be made large from the leading end to the trailing end of the image, the development positive ghost can be improved on the entire surface of the image.

In this embodiment, this was achieved by effecting potential difference control between the developing roller 4 and the regulating member 8. In the following, details of the control in this embodiment and an effect of the control will be described using a comparison example.

(Regulating Blade Bias Control)

Figure 3:
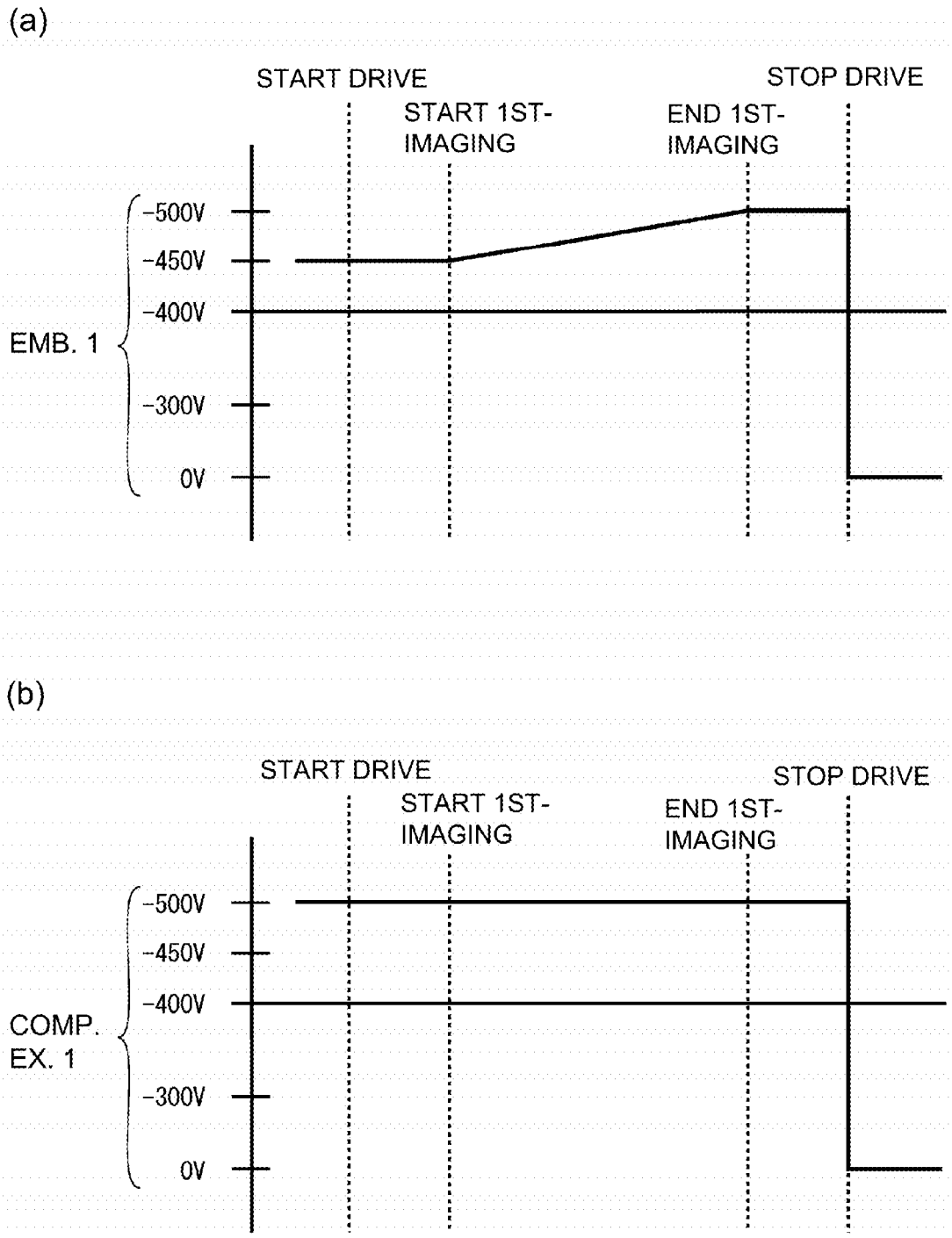
In FIG. 3, (a) is a timing chart of voltage control of the image forming apparatus in Embodiment 1, and (b) is a timing chart of voltage control of the image forming apparatus in Comparison Example 1-1.

Bias control of the developing roller 4 and the regulating member 8 in this embodiment will be described using FIG. 3. In FIG. 3, (a) and (b) are timing charts each showing the bias control of the regulating blade bias in the case where the image is printed on one sheet. The bias control of the developing roller 4 and the regulating member 8 is effected by the controller 150 by carrying out control of the respective portions in accordance with a timing chart described below.

Details of each timing in the timing chart will be described. In FIG. 3, "development drive start" timing is developing operation start timing when the developing roller 4 and the supplying roller 5 receive the driving force from the driving motor as the development driving means M2 and start rotation. Further, "image formation start" timing is writing timing of laser exposure with respect to the sub-scan direction, and "image formation end" timing is timing when the laser exposure with respect to the sub-scan direction is ended. Further, "development drive end" timing is developing operation end timing when the driving force from the driving motor as the development driving means M2 is terminated and the rotates of the developing roller 4 and the supplying roller 5 are stopped.

However, each timing is not limited thereto. For example, the "image formation start" timing may also be set so as to be earlier than the laser exposure writing timing with respect to the sub-scan direction by a predetermined time. Further, also the "image formation end" timing may also be set so as to be later than the laser exposure end timing by a predetermined time. Thus, each timing is changeable so as to be optimum depending on the constitutions of the developing device and the image forming apparatus.

The biases applied to the developing roller 4 are certain biases from the "development drive start" to the "development drive end", and in this embodiment, the bias applied to the developing roller 4 is −400 V, and the bias applied to the supplying roller 5 is −450 V.

Next, regulating blade bias control in one page of the recording material will be described. In this embodiment, bias control such that the bias applied to the regulating member 8 is provided with a slope (gradient) from the "image formation start" to the "image formation start" on the same recording material (one page) and is gradually increased in a direction of urging the toner from the regulating member 8 toward the developing roller 4.

The bias control is control such that the toner charge amount by the friction (sliding) at the contact portion between the developing roller 4 and the regulating member 8 is increased from the leading end toward the trailing end of the image. By this control, the toner charge amount on the developing roller 4 after white is increased from the leading end toward the trailing end of the image, and also the toner charge amount on the developing roller 4 after black can be increased from the leading end toward the trailing end of the image. As a result, it is possible to obtain the action of suppressing the charge amount difference between after white and after black from the leading end toward the trailing end of the image, so that an effect of improving the development positive ghost can be achieved. In this embodiment, control of changing a change amount per unit time of the bias applied to the regulating member 8 at a certain value was effected during the image formation.

Experiment

An experiment conducted for demonstrating the effect of this embodiment relative to Comparison Example will be described. In this embodiment, in an environment of a temperature of 23° C. and a humidity of 50% RH, the above-described development positive ghost discrimination image was printed on a LETTER-sized sheet, and then evaluation of the development positive ghost was carried out.

The discrimination of the development positive ghost was carried out by measuring a half-tone image density after black and a half-tone image density after white of the development positive ghost discrimination image by using a measuring device ("SPECTRODENSITOMETER 500", manufactured by X-Rite Inc.), and then by ranking a density difference therebetween on a scale of A to C.

A: On the half-tone image, the density difference is less than 0.02.

B: On the half-tone image, the density difference is not less than 0.02 and less than 0.06.

C: On the half-tone image, the density difference is not less than 0.06.

Figure 4:
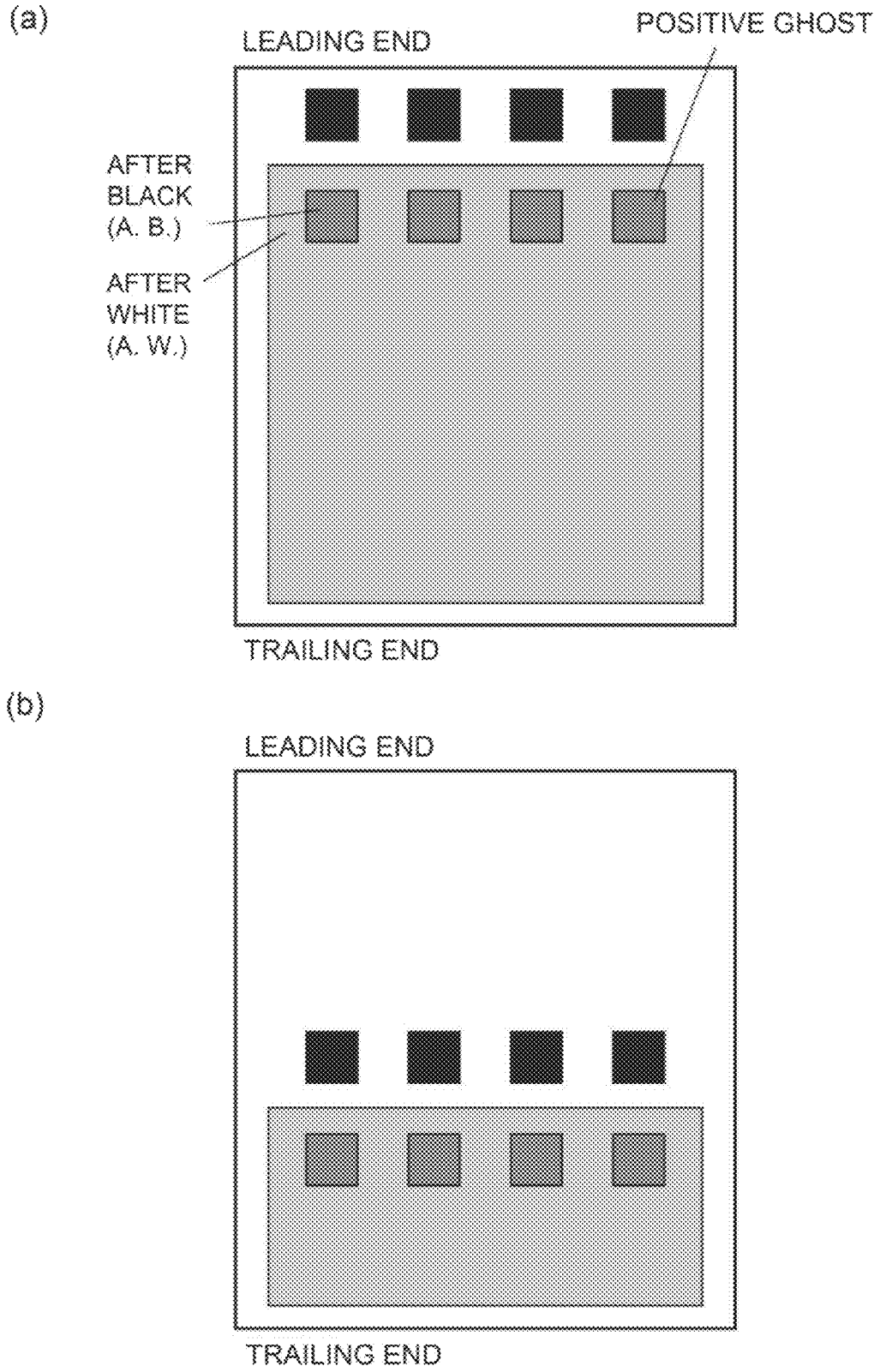
In FIG. 4, (a) and (b) are evaluation images of a development positive ghost.

In FIG. 4, (a) is a schematic view showing an example in which the development positive ghost generated on a discrimination image (a) including a solid patch image formed on the sheet at an image feeding side and a half-tone image formed on the sheet substantially at an entirety of a remaining surface of the sheet. In FIG. 4, (a) shows the example in which the development positive ghost having a density higher than the half-tone region generated on the half-tone image of the discrimination image (a) at a position corresponding to the position of the solid patch image. Further, in FIG. 4, (b) is a schematic view showing an example in which the development positive ghost generated on a discrimination image (b) including a solid patch image formed on the sheet at an image trailing end side and a half-tone image formed on the sheet substantially at an entirety of a remaining surface of the sheet. In FIG. 4, (b) shows the example in which the development positive ghost having a density higher than the half-tone region generated on the half-tone image of the discrimination image (b) at a position corresponding to the position of the solid patch image.

As an example for comparison with the effect of Embodiment 1, a similar experiment was conducted for the case where bias control in Comparison Example 1-1 shown in (b) of FIG. 3, and the evaluation of the development positive ghost was carried out.

In Comparison Example 1-1, control in which a certain bias was applied from the "development drive start" to the "development drive end", and was −500 V. In Table 1 shown below, a result of image evaluation of the development positive ghost discrimination image printed on a single sheet was shown.

Figure 5:
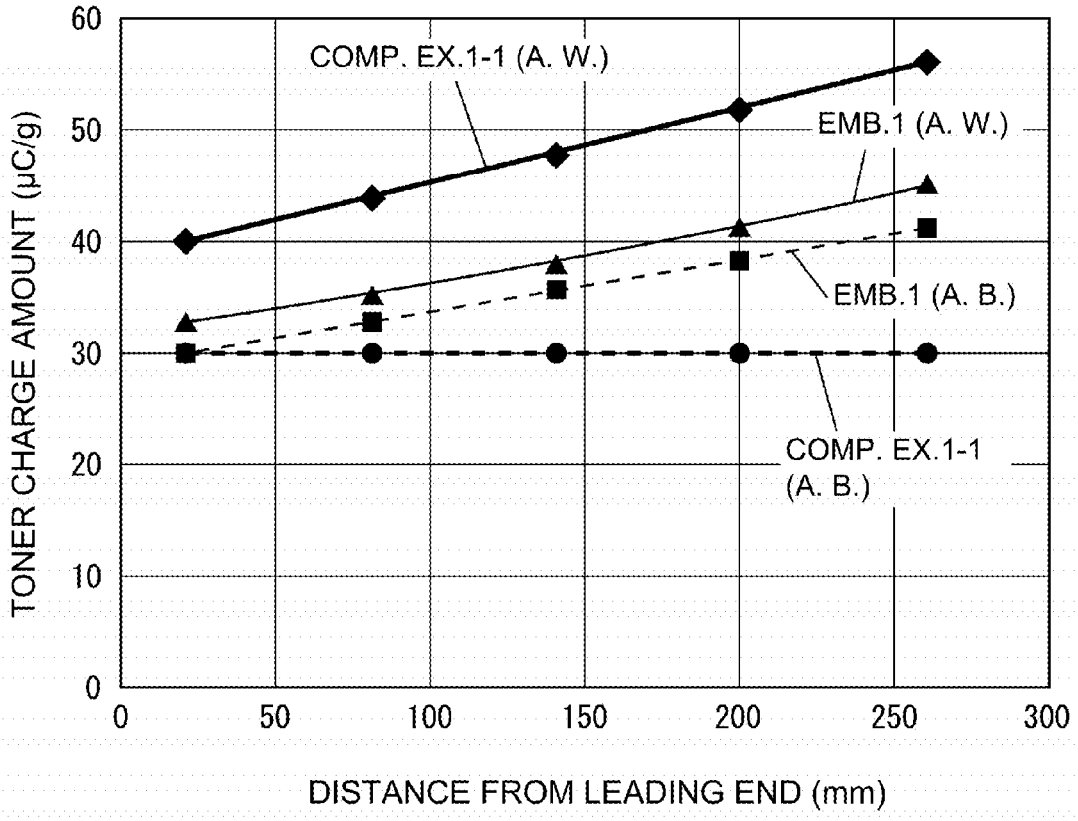
FIG. 5 is a graph showing a measurement result of toner charge amounts on developing rollers in Embodiment 1 and Comparison Example 1-1.

In each of Embodiment 1 and Comparison Example 1-1, measurement of the charge amount (μC/g) of the toner coated on the developing roller 4 after passing through the regulating member 8 was carried out, and a result of the measurement was shown in FIG. 5. The measurement of the charge amount was carried out after the operation of the developing device was stopped during the printing of a whole-surface solid image and a whole-surface white image. Measuring positions were 20 mm, 80 mm, 140 mm, 200 mm and 260 mm from the leading end of the image.

TABLE 1

| | (a) | (b) |
|---|---|---|
| EMB. 1 | A | A |
| COMP. EX. 1 | B | C |

Here, the result shown in FIG. 5 will be described. When the charge amounts at the position of 20 mm from the image leading end in Embodiment 1 and Comparison Example 1-1 are compared with each other, it is understood that as regards after white, the charge amount is smaller in Embodiment 1 than in Comparison Example 1-1. On the other hand, it is understood that as regards after black, the charge amount difference between after white and after black is small. This is because compared with Comparison Example 1-1, in Embodiment 1, the regulating blade bias applied to the regulating member 8 at the position of 20 mm from the image leading end is small.

Then, a change in charge amount from the image leading end to the image trailing end will be compared between Embodiment 1 and Comparison Example 1-1. It is understood that the charge amount after white increases from the image leading end toward the image trailing end in Comparison Example 1-1. Further, in Comparison Example 1-1, the charge amount after black remains unchanged from the image leading end to the image trailing end. For that reason, it is understood that the charge amount difference between after white and after black increases from the image leading end toward the image trailing end. On the other hand, in Embodiment 1, similarly as in Comparison Example 1-1, the charge amount after white increases from the image leading end toward the image trailing end, but different from Comparison Example 1-1, also the charge amount after black increases from the image leading end toward the image trailing end. For that reason, in Embodiment 1, the charge amount difference between after white and after black is not broadened and thus is maintained from the image leading end toward the image trailing end. This is because the regulating blade bias is constant from the image leading end to the image trailing end in Comparison Example 1-1, whereas the regulating blade bias is increased from the image leading end toward the image trailing end in Embodiment 1. That is, in Embodiment 1, the bias control is effected so that the force for urging the toner, between the regulating member 8 and the developing roller 4, from the regulating member 8 toward the developing roller 4 acts on the toner strongly at the image trailing end more than at the image leading end.

Next, a result of Table 1 will be described. In the case where the control in Comparison Example 1-1 is effected, there is a charge amount difference between after white and after black from the image leading end, and therefore the development positive ghost generates on the discrimination image (a). Further, in the image trailing end side, as described above, the charge amount difference between after white and after black increases, and therefore on the discrimination image (b), the development positive ghost becomes worse. On the other hand, in the case where the control in Embodiment 1 is effected, the charge amount difference between after white and after black is suppressed compared with Comparison Example 1-1, and therefore the development positive ghost did not generate on the discrimination image (a). Further, the charge amount difference between after white and after black can be maintained from the image leading end and the image trailing end in a small state, and therefore also on the discrimination image (b), the development positive ghost did not generate.

Thus, according to this embodiment, the control of providing the potential difference between the developing roller 4 and the regulating member 8 is effected so that the force for urging the toner, at the contact portion between the regulating member 8 and the developing roller 4 from the regulating member 8 toward the developing roller 4 acts on the toner from the image leading end to the image trailing end on the same (one) recording material. And, the control of providing the potential difference so that the force for urging the toner from the regulating member 8 toward the developing roller 4 acts on the toner more strongly at the image trailing end than at the image leading end. As a result, it becomes possible to alleviate a degree of the development positive ghost generating in the case where the developing device in which the surfaces of the developing roller 4 and the supplying roller 5 move (rotate) in the same direction is used.

Incidentally, in a developing device ("with" developing device) in which surfaces of the developing roller and the photosensitive drum move in the same direction at the contact portion where the developing roller and the photosensitive drum oppose each other, a physical (mechanical) toner peeling off property of the developer supplying roller is weak, and therefore a remarkable developing ghost is generated in some cases. Therefore, in a method of enhancing the mechanical toner peeling-off property of the developer supplying roller in order to reduce the degree of the developing ghost, mechanical friction (sliding) between the developing roller and the developer supplying roller increases, and for that reason, the toner deterioration was promoted. Thus, when the toner deterioration, i.e., liberation and burying of an external additive at the developer surface was promoted, a lowering in charging performance and an increase in degree of agglomeration were caused, and thus a problem such as toner filming such that the toner was melted on the developing roller surface generated and constituted an obstacle to lifetime extension of the developing device. However, according to this embodiment, the degree of the development positive ghost can be alleviated without enhancing the mechanical toner peeling-off property of the developer supplying roller, so that it is possible to provide an image forming apparatus capable of providing a high image quality and capable of meeting the lifetime extension.

Embodiment 2

An image forming apparatus according to Embodiment 2 will be described. In the following description, portions similar to those in Embodiment 1 will be omitted from description.

In the case where a continuous printing on a plurality of recording materials is carried out, the image forming apparatus performs a pre-rotation operation in a period from "development drive start" to "first-sheet image formation start" (hereinafter referred to as pre-rotation (period)). In the period in which the pre-rotation operation is performed, the developing roller 4 rotates in a state in which the latent image is not developed, and therefore the toner on the developing roller 4 is in an after white state. A trailing distance of the developing roller 4 during the pre-rotation operation in this embodiment is 456 mm. Further, also in an interval between the recording materials from "first-sheet image formation end" to "second-sheet image formation start" (hereinafter referred to as a sheet interval), the developing roller 4 rotates in the state in which the latent image is not developed, and therefore the toner on the developing roller 4 is in the after white state. However, a traveling distance in the sheet interval is shorter than that during the pre-rotation in many cases. In this embodiment, the traveling distance in the sheet interval is 31 mm.

The development positive ghost deteriorates due to a large charge amount difference between after white and after black, and the charge amount after white increases with a longer time when the developing roller 4 rotates in the state in which the latent image is not developed. Accordingly, in the case where the continuous printing is carried out, a level of the development positive ghost is different between the first recording material (sheet) after the pre-rotation operation and the second and subsequent recording materials (sheets) after the (first) sheet interval, so that the degree of the development positive ghost on the second and subsequent recording materials is improved compared with that on the first recording material. For that reason, in the case where the continuous printing on the plurality of recording materials is carried out, as regards the images on the second and subsequent recording materials, the control of the regulating blade bias can be switched from control in which the bias is applied with the slope (gradient) to control in which the bias is applied at a constant level.

Figure 6:
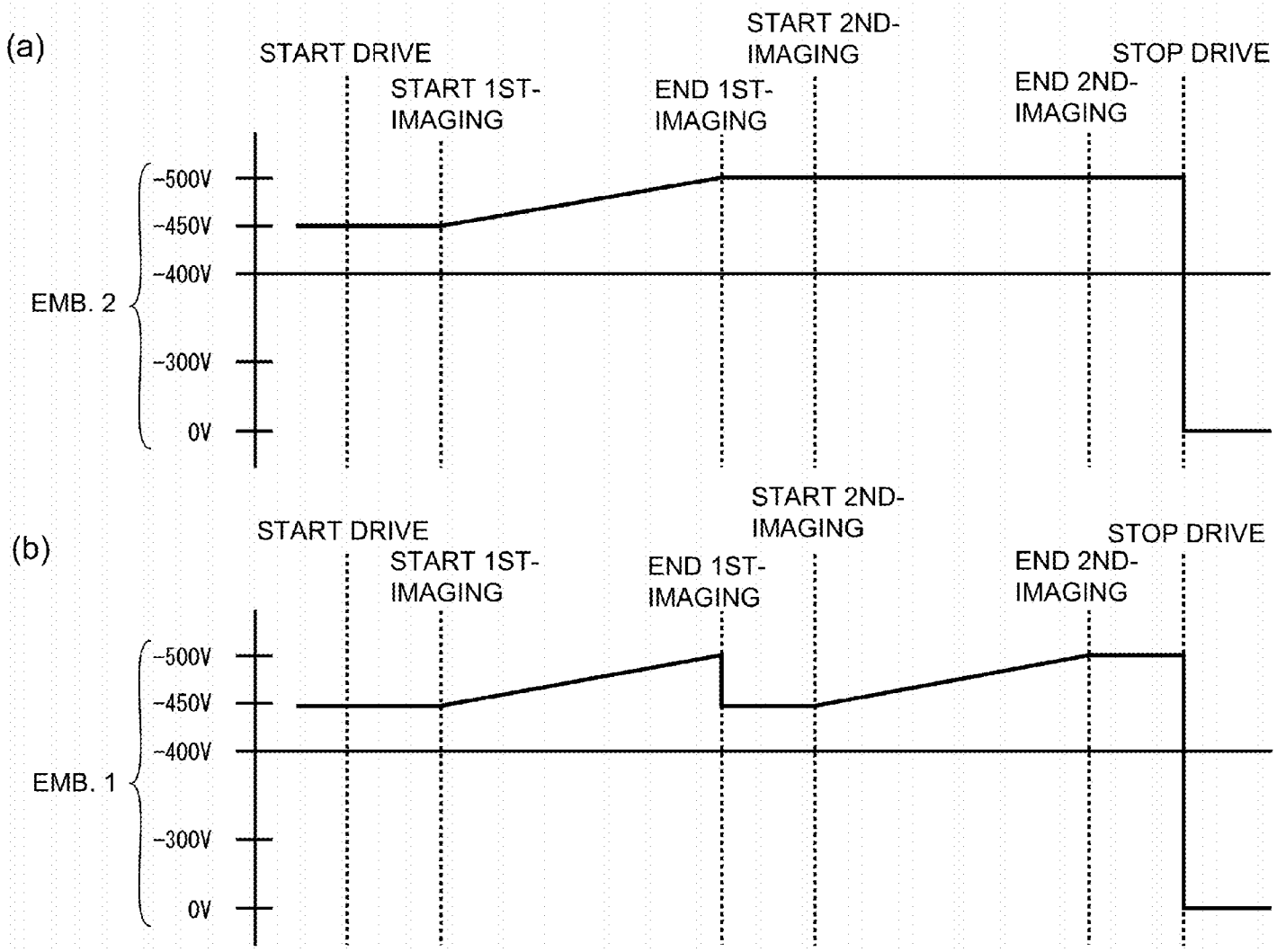
In FIG. 6, (a) is a timing chart of voltage control of the image forming apparatus in Embodiment 2, and (b) is the timing chart of voltage control of the image forming apparatus in Embodiment 1.

Therefore, in this embodiment, the control of the regulating blade bias in the case where the continuous printing on the plurality of recording materials is carried out will be described. In FIG. 6, (a) and (b) are timing charts showing bias control of regulating blade biases in Embodiments 2 and 1, respectively, in the case where continuous printing on 2 recording materials is carried out.

In Embodiment 1, the bias control from "first-sheet image formation start" to "first-sheet image formation end" and the bias control from "second-sheet image formation start" to "second-sheet image formation end" are carried out using the same waveform. Specifically, after the "first-sheet image formation end" (developing operation end), the bias is reset to −450 V equal to the bias at the time of the "first-sheet image formation start" (developing operation start). Thus, the bias control from "image formation start" to "image formation end" on the second and subsequent recording materials is repeated similarly as in the bias control form the "first-sheet image formation start" to the "first-sheet image formation end".

On the other hand, in Embodiment 2, the bias control from the "first-sheet image formation start" to the "first-sheet image formation end" is carried out with the bias applied to the regulating member 8 with the slope (gradient) similarly as in Embodiment 1. However, in Embodiment 2, the bias control of the regulating member 8 from the "first-sheet image formation end" to the "second-sheet image formation end" is effected by control of applying a certain bias. At this time, the certain bias is −500 V.

Experiment

An experiment conducted for demonstrating the effect of this embodiment will be described. In this embodiment, in an environment of a temperature of 23° C. and a humidity of 50% RH, the above-described development positive ghost discrimination image was printed on a LETTER-sized sheet, and then evaluation of the development positive ghost was carried out.

The discrimination of the development positive ghost was carried out by measuring a half-tone image density after black and a half-tone image density after white of the development positive ghost discrimination image, shown in (a) and (b) of FIG. 4, by using a measuring device ("SPECTRODENSITOMETER 500", manufactured by X-Rite Inc.), and then by ranking a density difference therebetween on a scale of A to C described above.

In Table 2, an evaluation result of the images on both of the first sheet and the second sheet is shown.

TABLE 2

| | First sheet | | Second sheet | |
|---|---|---|---|---|
| | (a) | (b) | (a) | (b) |
| EMB. 2 | A | A | A | A |
| EMB. 1 | A | A | A | A |

The result of Table 2 will be described. In both of Embodiments 1 and 2, the development positive ghost did not generate. As regards Embodiment 1, as described above, the development positive ghost is improved by the regulating blade bias control, and its effect is achieved on both of the first sheet and the second sheet of the recording materials. On the other hand, in Embodiment 1, the regulating blade bias control from the "development drive start" to "first-sheet image formation end" is the same as that in Embodiment 1, and therefore the development positive ghost does not generate in the image on the first recording material. Further, from the "first-sheet image formation end" to "second-sheet image formation start", the developing roller 4 rotates in the state in which the latent image is not developed, but the time is short, and therefore, the toner charge amount on the developing roller 4 after white is small compared with that in the case of the first recording material. For that reason, the charge amount difference on the developing roller 4 between after white and after black is small, so that it was possible to obtain a result such that even when the regulating blade bias is constant, the development positive ghost did not generate.

As described above, according to Embodiment 2, even in the case where the continuous printing on the plurality of recording materials is carried out, it becomes possible to alleviate the degree of the development positive ghost.

Embodiment 3

An image forming apparatus according to Embodiment 3 will be described. In the following description, portions similar to those in Embodiments 1 and 2 will be omitted from description.

The development positive ghost is determined by a difference in toner charge amount on the developing roller 4 between after white and after black, and therefore as in an environment of a low temperature and low humidity condition (temperature: 15° C., humidity; 10% RH), in the environment in which the toner charge amount increases, the degree of the development positive ghost becomes worse.

Figure 8:
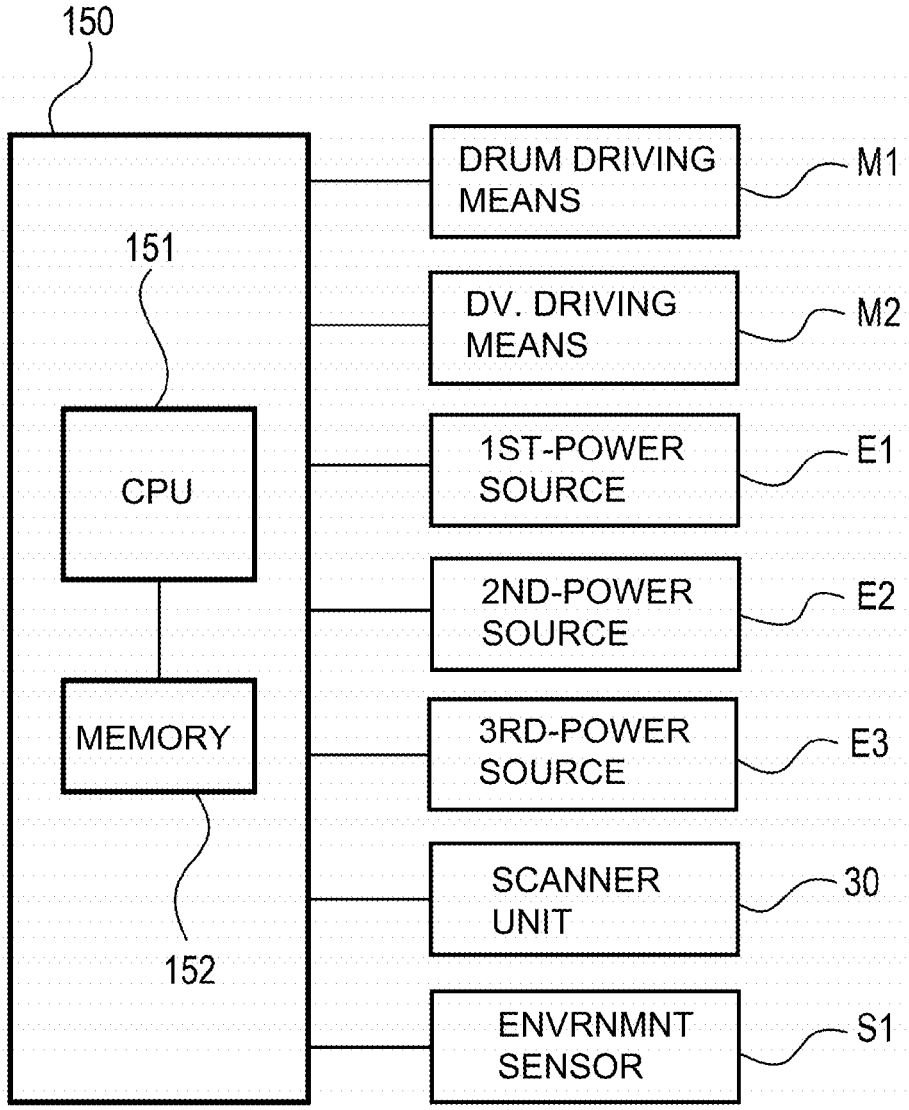
FIG. 8 is a block diagram showing a constitution of a control system of the image forming apparatus.

The image forming apparatus according to this embodiment includes, as shown in FIG. 8, an environment sensor S1 as an environment detecting means (temperature and humidity detecting means, a thermometer and a hygrometer). Environment information (toner and humidity information) detected by this environment sensor S1 is inputted into the controller 150. On the basis of this environmental information, the controller 150 effects the following bias control in the environment of the low temperature and low humidity condition.

In Embodiment 3, an example in which the development positive ghost in the environment of the low temperature and low humidity condition is improved will be shown.

In the environment of the low temperature and or humidity condition, the toner charge amount on the developing roller 4 increases. For that reason, the charge amount difference of the toner on the developing roller 4 between after white and after black becomes larger, so that the development positive ghost becomes worse. Therefore, in such an environment, in order to further improve the development positive ghost, there is a need to suppress the charge amount of the toner on the developing roller 4 by, e.g., suppressing the charge amount at the contact portion between the developing roller 4 and the regulating member 8. As a means for suppressing the charge amount at the contact portion, there is a method of reversing a potential relationship between the developing bias applied to the developing roller 4 and the regulating blade bias applied to the regulating member 8. That is, the method is such that the direction of the force for urging the toner at the contact portion between the developing roller 4 and the regulating member 8 is reversed from the direction from the regulating member 8 toward the developing roller 4 to the direction from the developing roller 4 toward the regulating member 8.

Figure 7:
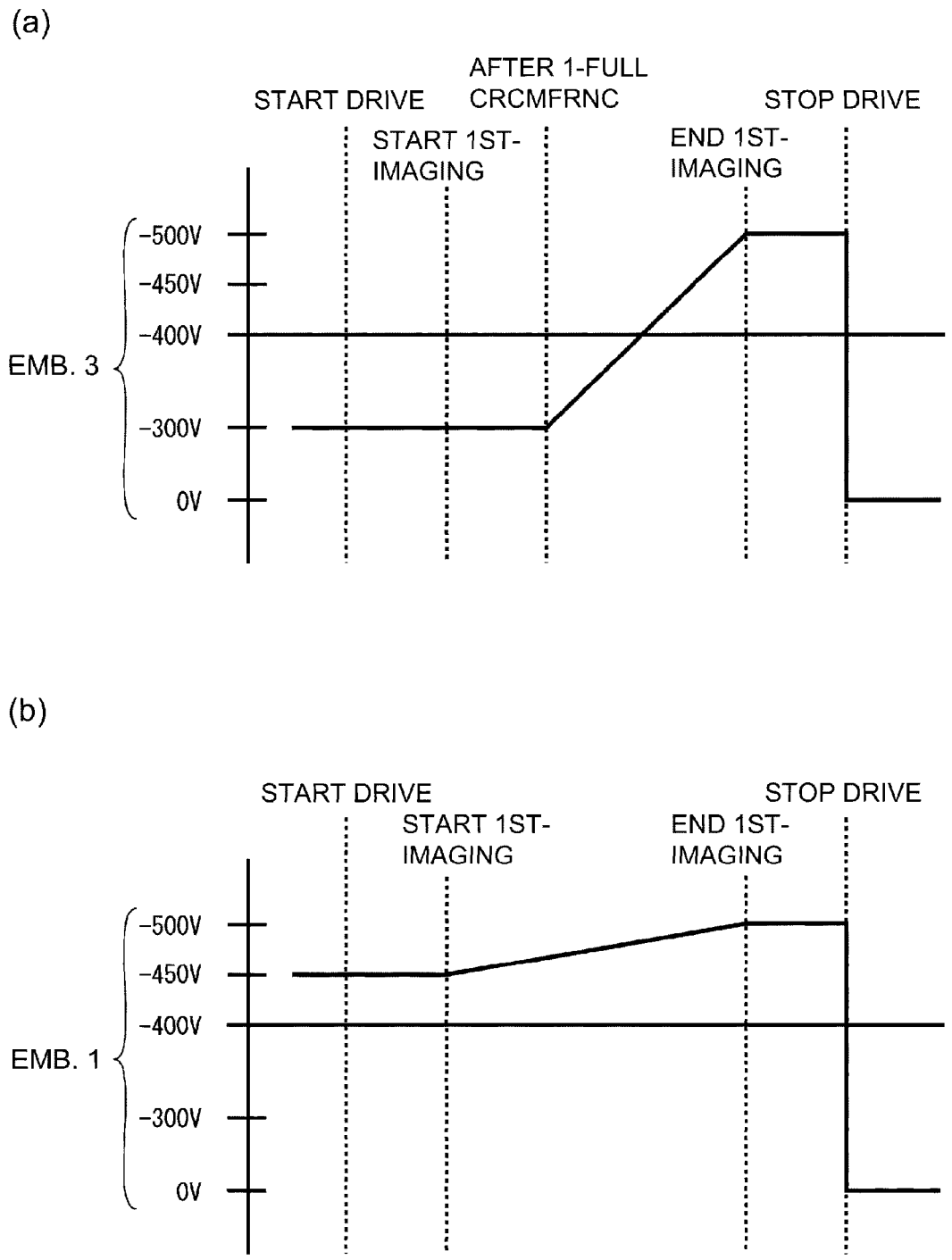
In FIG. 7, (a) is a timing chart of voltage control of the image forming apparatus in Embodiment 3, and (b) is the timing chart of voltage control of the image forming apparatus in Embodiment 1.

In FIG. 7, (a) and (b) are timing charts showing bias control of regulating blade biases in Embodiments 3 and 1, respectively, in the case where printing on a single recording material is carried out.

In Embodiment 1, the regulating blade bias is the certain bias of −450 V during the pre-rotation, and thereafter is increased in absolute value from −450 V to −500 V in a period from the "image formation start" toward the "image formation end". On the other hand, in Embodiment 3, the regulating blade bias is a certain bias of −300 V from the "development drive start" to "after one full circumference (turn) of developing roller 4", and thereafter is increased in absolute value from −300 V to −500 V in a period from "after one full circumference of developing roller 4" toward the "image formation end".

By this control, in Embodiment 1, although the magnitude of the regulating blade bias changes with respect to the single recording material, the force for urging the toner from the regulating member 8 toward the developing roller 4 always acts on the toner at the contact portion. On the other hand, in Embodiment 3, the regulating blade bias is constant from the "development drive start" to the "after one full circumference of developing roller 4", and thereafter is controlled so as to change its polarity by crossing a point of the potential difference of 0 V in the period from the "after one full circumference of developing roller 4" to the "image formation end". As a result, during the recording on the same recording material, from the "development drive start" to the "after one full circumference of developing roller 4", the force for urging the toner from the developing roller 4 toward the regulating member 8 continuously acts on the toner at the contact portion. On the other hand, from the "after one full circumference of developing roller 4" to the "image formation end", the direction in which the toner at the contact portion is urged is reversed to the direction of the force from the regulating member 8 to the developing roller 4.

Experiment

In order to demonstrate an effect of this embodiment, the image forming apparatuses in Embodiments 1 and 3 were subjected to the same experiment as that in Embodiment 1 except that the environment in which the experiment was conducted was changed to an environment of 15° C. in temperature and 10% RH in humidity.

Table 3 shows an evaluation result of printing of the development positive ghost discrimination images (a), (b) on the single recording material.

TABLE 3

| | (a) | (b) |
|---|---|---|
| EMB. 3 | A | A |
| EMB. 1 | B | C |

Here, the result shown in Table 3 will be described. In Embodiment 1, the environment in which the experiment was conducted was a severe condition of the temperature of 15° C. and the humidity of 10% RH, and therefore, on the evaluation image, the development positive ghost generated. On the other hand, in Embodiment 3, the direction in which the toner urging force acts on the toner at the contact portion is reversed to the direction of the force from the developing roller 4 toward the regulating member 8 until the force applying position reaches the image trailing end, and therefore, the charge amount of the toner on the developing roller 4 decreases, so that the development positive ghost was improved.

Form the above-described experiment, by effecting the regulating blade bias control in Embodiment 3, even in the low temperature and low humidity environment, it becomes possible to improve the development positive ghost.

Embodiment 4

An image forming apparatus according to Embodiment 4 will be described. In the following description, portions similar to those in Embodiments 1 to 3 will be omitted from description.

Figure 9:
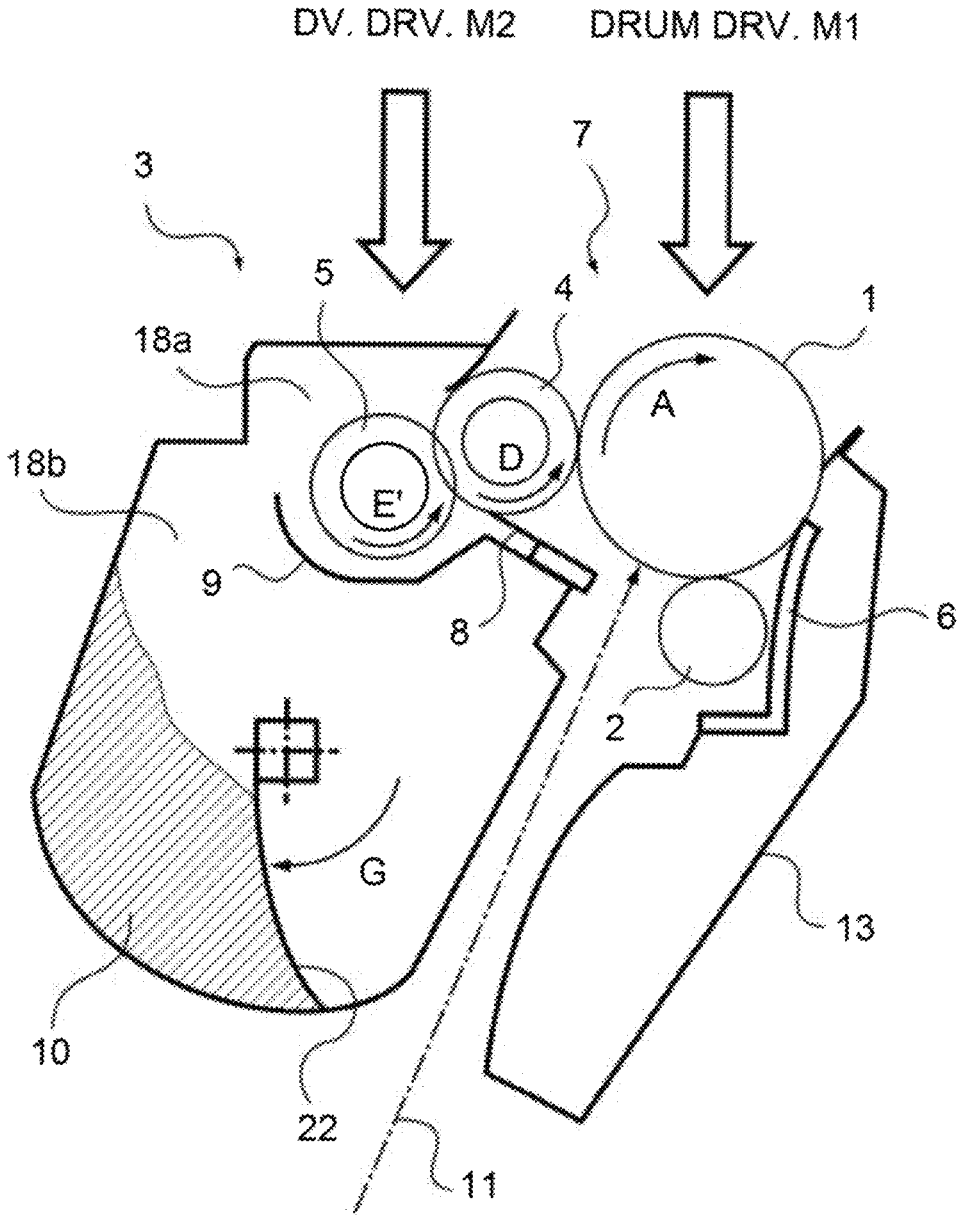
FIG. 9 is a schematic view of a process cartridge in Embodiment 4.

In Embodiments 1 to 3, the example in which the supplying roller 5 and the developing roller 4 rotated so that their opposing surfaces at the contact portion therebetween moved in the same direction was described. However, in this embodiment, as shown in FIG. 9, a constitution in which the supplying roller 5 rotates in an arrow E direction and thus the supplying roller 5 and the developing roller 4 rotate so that their opposing surfaces at the contact portion therebetween move in opposite directions is employed. Also in the case where the respective surfaces of the developing roller 4 and the supplying roller 5 rotate in the opposite directions, the triboelectric charge difference on the developing roller 4 between after white and after black generates. For this reason, it is possible to obtain a similar effect to those in Embodiments 1 to 3 irrespective of the rotational direction of the supplying roller 5, so that by employing the constitution in Embodiment 4, it becomes possible to alleviate the developing ghost further satisfactorily.

Other Embodiments

In the above-described embodiments, as the control of providing the potential difference between the developing roller 4 and the regulating member 8, the control of changing the bias applied to the regulating member 8 was described as an example, but the control is not limited thereto. When the control provides the potential difference between the developing roller 4 and the regulating member 8, control of changing the bias applied to the developing roller 4 and control of changing the biases applied to the developing roller 4 and the regulating member 8 may also be employed.

In the above-described embodiments, the four process cartridges (image forming portions) are used, but the number of the process cartridges is not limited thereto and may be appropriately changed as desired.

In the above-described embodiments, as the process cartridge detachably mountable to the image forming apparatus, the process cartridge integrally including the photosensitive drum and, as the process means actable on the photosensitive drum, the charging means, the developing means and the cleaning means was illustrated. However, the process cartridge is not limited thereto. A process cartridge integrally including the photosensitive drum and either one of the charging means, the developing means and the cleaning means may also be used.

In the above-described embodiments, the constitution in which the process cartridge integrally including the drum unit including the photosensitive drum and the developing unit including the developing roller is detachably mountable to the image forming apparatus was illustrated, but the present invention is not limited thereto. For example, a constitution in which each of the developing unit including the developing roller and the drum unit including the photosensitive drum is detachably mountable to the image forming apparatus may also be employed.

In the above-described embodiments, as the image forming apparatus, the printer was illustrated, but the present invention is not limited thereto. For example, other image forming apparatuses such as a copying machine, a facsimile machine, a multi-function machine having functions of these machines may also be used. By applying the present invention to these image forming apparatuses, an effect similar to those in the above-described embodiments can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-252860 filed on Dec. 25, 2015, and 2016-234840 filed on Dec. 2, 2016, which are hereby incorporated by reference herein in their entirety.

What is claimed is:

1. An image forming apparatus, comprising:

a developing device including a rotatable developer carrying member for carrying a developer, a developer supplying member for supplying the developer to said developer carrying member, and a regulating member for regulating an amount of the developer carried by said developer carrying member in contact with said developer carrying member;

a first power source for applying a bias to said developer carrying member;

a second power source for applying a bias to said regulating member; and a controller for controlling said first and second power sources, wherein in a period from a start of a developing operation to an end of the developing operation for printing an image on a single recording material, said controller effects control of a potential difference between said developer carrying member and said regulating member so that a force for urging the developer from said regulating member toward said developer carrying member acts on the developer at a contact portion between said regulating member and said developer carrying member, with the potential difference being controlled so that the force acting on the developer is stronger at the end of the developing operation than at the start of the developing operation on the single recording material.

2. An image forming apparatus according to claim 1, wherein said developer supplying member rotates at the contact portion with said developer carrying member in a direction in which a surface thereof moves in the same direction as a surface of said developer carrying member.

3. An image forming apparatus according to claim 2, wherein when recording is effected continuously on a plurality of recording materials, with respect to the single recording material, said controller effects the control of potential difference so that the force for urging the developer from said regulating member toward said developer carrying member is stronger at the end of the developing operation than at the start of the developing operation, and wherein when the recording is effected on another recording material after the developing operation is ended and the bias is reset to that at the start of the developing operation, said controller effects the same control.

4. An image forming apparatus according to claim 2, wherein when recording is effected continuously on a plurality of recording materials, for a first single recording material, said controller effects the control of the potential difference so that the force for urging the developer from said regulating member toward said developer carrying member is stronger at the end of the developing operation than at the start of the developing operation, and for second and subsequent recording materials, in the period from the start of the developing operation to the end of the developing operation, said controller effects control so that the potential difference between said developer carrying member and said regulating member is the same as that at the end of the developing operation for the first single recording material.

5. An image forming apparatus according to claim 2, further comprising an environment sensor for detecting an environment, wherein in the period from the start of the developing operation to the end of the developing operation for the single recording material, said controller effects control of the potential difference between said developer carrying member and said regulating member so that a force for urging the developer from said developer carrying member toward said regulating member acts on the developer at the contact portion between said regulating member and said developer carrying member, after the end of the developing operation, said controller effects control of the potential difference so that the force for urging the developer from said regulating member toward said developer carrying member acts on the developer.

6. An image forming apparatus according to claim 2, wherein said controller effects control of the potential difference between the developer carrying member and the regulating member so that a force for urging the developer from the developer carrying member toward the regulating member acts on the developer at the start of the developing operation, and effects control of the potential difference between the developer carrying member and the regulating member so that the force for urging the developer from the regulating member toward the developer carrying member acts on the developer at the end of the developing operation.

7. An image forming apparatus according to claim 1, wherein said developer supplying member rotates at the contact portion with said developer carrying member in a direction in which a surface thereof moves in an opposite direction to a direction in which a surface of said developer carrying member moves.

8. An image forming apparatus according to claim 7, wherein when recording is effected continuously on a plurality of recording materials, with respect to the single recording material, said controller effects the control of the potential difference so that the force for urging the developer from said regulating member toward said developer carrying member is stronger at the end of the developing operation than at the start of the developing operation, and wherein when the recording is effected on another recording material after the developing operation is ended and the bias is reset to that at the time of the start of the developing operation, said controller effects the same control.

9. An image forming apparatus according to claim 7, wherein when recording is effected continuously on a plurality of recording materials, for a first single recording material, said controller effects the control of the potential difference so that the force for urging the developer from said regulating member toward said developer carrying member is stronger at the end of the developing operation than at the start of the developing operation, and for second and subsequent recording materials, in the period from the start of the developing operation to the end of the developing operation, said controller effects control so that the potential difference between said developer carrying member and said regulating member is the same as that at the end of the developing operation for the first single recording material.

10. An image forming apparatus according to claim 7, further comprising an environment sensor for detecting an environment, wherein in the period from the start of the developing operation to the end of the developing operation for the single recording material, said controller effects control of the potential difference between said developer carrying member and said regulating member so that a force for urging the developer from said developer carrying member toward said regulating member acts on the developer at the contact portion between said regulating member and said developer carrying member, after the end of the developing operation, said controller effects control of the potential difference so that the force for urging the developer from said regulating member toward said developer carrying member acts on the developer.

11. An image forming apparatus according to claim 7, wherein said controller effects control of the potential difference between the developer carrying member and the regulating member so that a force for urging the developer from the developer carrying member toward the regulating member acts on the developer at the start of the developing operation, and effects control of the potential difference between the developer carrying member and the regulating member so that the force for urging the developer from the regulating member toward the developer carrying member acts on the developer at the end of the developing operation.

* * * * *